US007784439B2

(12) United States Patent
Kim et al.

(10) Patent No.: US 7,784,439 B2
(45) Date of Patent: Aug. 31, 2010

(54) VARIABLE VALVE LIFT APPARATUS

(75) Inventors: Dae Sung Kim, Hwaseong (KR); Wootae Kim, Suwon (KR); Back Sik Kim, Osan (KR); Hyung-Ick Kim, Gunpo (KR); Ingee Suh, Yongin (KR); Dong Hee Han, Seoul (KR); Kyoung Pyo Ha, Suwon (KR)

(73) Assignee: Hyundai Motor Company, Seoul (KR)

( * ) Notice: Subject to any disclaimer, the term of this patent is extended or adjusted under 35 U.S.C. 154(b) by 332 days.

(21) Appl. No.: 11/966,548

(22) Filed: Dec. 28, 2007

(65) Prior Publication Data

US 2009/0090320 A1 Apr. 9, 2009

(30) Foreign Application Priority Data

Oct. 5, 2007 (KR) ..... 10-2007-0100309

(51) Int. Cl.
*F01L 1/18* (2006.01)

(52) U.S. Cl. ..... 123/90.48; 123/90.16; 123/90.27

(58) Field of Classification Search ..... 123/90.16, 123/90.48, 90.27, 90.5, 90.12
See application file for complete search history.

(56) References Cited

U.S. PATENT DOCUMENTS 5,555,861 A 9/1996 Mayr et al.
5,709,180 A * 1/1998 Spath ..... 123/90.16

* cited by examiner

*Primary Examiner*—Zelalem Eshete
(74) *Attorney, Agent, or Firm*—Morgan, Lewis & Brockius LLP

(57) ABSTRACT

A variable valve lift apparatus according to an exemplary embodiment of the present invention may include an outer part, an inner part disposed in the outer part and connected to a valve, a latching part that is disposed in the outer part and selectively connects the outer part and the inner part, a camshaft supplying torque, a low lift cam that is configured to the camshaft and selectively supplies torque to the inner part, and a high lift cam that is configured to the camshaft and supplies torque to the outer part.

12 Claims, 7 Drawing Sheets

(A)

(B)

(A)

(B)

(A)

(B)

VARIABLE VALVE LIFT APPARATUS

CROSS-REFERENCE TO RELATED APPLICATION

This application claims priority to and the benefit of Korean Patent Application No. 10-2007-0100309, filed in the Korean Intellectual Property Office on Oct. 5, 2007, the entire contents of which are incorporated herein by reference.

BACKGROUND OF THE INVENTION (a) Field of the Invention

The present invention relates to a variable valve lift apparatus. More particularly, the present invention relates to a variable valve lift apparatus that uses hydraulic pressure to selectively connect an inner body and an outer body and can change valve lift.

(b) Description of the Related Art

Generally, an automotive engine includes a combustion chamber in which fuel burns to generate power. The combustion chamber is provided with an intake valve for supplying a gas mixture containing the fuel and an exhaust valve for expelling the burned gas. The intake and exhaust valves open and close the combustion chamber by a valve lift apparatus connected to a crankshaft.

A conventional valve lift apparatus has a fixed valve lift length using a cam formed in a predetermined shape. Therefore, it is impossible to adjust the amount of a gas that is being introduced or exhausted. Therefore, the engine does not run at its optimum state in various driving ranges.

For example, if a valve lift apparatus is designed to optimally respond to a low driving speed, the valve open time and amount for the low driving speed are not sufficient for a high speed driving state. On the contrary, when the valve lift apparatus is designed to optimally respond to a high speed driving state, an opposite phenomenon occurs in the low speed driving state.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a variable valve lift apparatus that is configured with simple elements, uses hydraulic pressure to selectively connect an inner body and an outer body, and can change valve lift.

Also, the present invention has been made in an effort to provide a variable valve lift apparatus that can operate in a CDA mode with a simple design change.

A variable valve lilt apparatus according to an exemplary embodiment of the present invention may include an outer part, an inner part disposed in the outer part and connected to a proximate end portion of a valve, a latching part that is disposed in the outer part and selectively connects the outer part and the inner part, a camshaft supplying torque of an engine, a low lift earn that is configured to the camshaft and selectively supplies the torque to the inner part and a high lift cam that is configured to the camshaft and supplies the torque to the outer part.

The latching part may include a latching pin guide, a latching pin disposed in the latching pin guide, and a latching pin elastic portion that is disposed in the latching pin guide and supplies elastic force to the latching pin, and the latching pin locks the inner part when the latching pin receives hydraulic pressure by overcoming a deformation force of the latching pin elastic portion.

The inner part may include an inner body that has a cylindrical shape, has at least an inner body spline formed on a circumference of the inner body, and is connected to the proximate end portion of the valve, and an inner body guide that is disposed such that the inner body may reciprocate. The latching pin has at least a latching pin spline formed on an interior circumference thereof, and the inner body is disposed complementarily along the interior circumference of the latching pin.

The outer part may include an outer body cap where at least a hydraulic line for supplying hydraulic pressure is formed, and the outer body cap fixes the inner body guide and an outer body enclosing the outer body cap. A lost motion spring may be disposed in the outer body cap for supplying elastic restoring force to the outer part.

At least an air hole may be formed in the outer body for the latching pin to move smoothly.

At least a locking pin may be disposed in the outer body for preventing rotation of the outer body. At least a fixing pin may be disposed in the outer body for fixing relative positions of the outer body and the latching pin guide.

A variable valve lift apparatus according to another exemplary embodiment of the present invention may include an outer part, an inner part disposed in the outer part and connected to a proximate end portion of a valve, a latching part that is disposed in the outer part and selectively connects the outer part and the inner part, a camshaft supplying torque of an engine, and a cam that is configured to the camshaft and supplies the torque to the outer part.

The latching part may include a latching pin guide, a latching pin disposed in the latching pin guide, and a latching pin elastic portion that is disposed in the latching pin guide and supplies elastic force to the latching pin, and the latching pin releases the inner part when the latching pin receives hydraulic pressure by overcoming a deformation force of the latching pin elastic portion.

The inner part may include an inner body that has a cylindrical shape, has at least an inner body spline on a circumference of the inner body, and is connected to the proximate end portion of the valve, and an inner body guide that is disposed such that the inner body may reciprocate. The latching pin has at least a latching pin spline on an interior circumference thereof, and the inner body is disposed complementarily within the interior circumference of the latching pin.

The outer part may include an outer body cap where at least a hydraulic line for supplying the hydraulic pressure is formed, and the outer body cap fixes the inner body guide and an outer body enclosing the outer body cap. A lost motion spring may be disposed in the outer body cap for supplying elastic restoring force to the outer part.

At least an air hole may be formed in the outer body for the latching pin to move smoothly.

At least a locking pin may be disposed in the outer body for preventing rotation of the outer body. At least a fixing pin may be disposed in the outer body for fixing relative positions of the outer body and the latching pin guide.

A variable valve lift apparatus according to an exemplary embodiment of the present invention is configured with simple elements, uses hydraulic pressure to selectively connect an inner body and an outer body, and can change valve lift.

Also, a variable valve lift apparatus according to another exemplary embodiment of the present invention can operate in a CDA mode with a simple design change.

The above features and advantages of the present invention will be apparent from or are set forth in more detail in the accompanying drawings, which are incorporated in and form a part of this specification, and the following Detailed Description of the Invention, which together serve to explain, by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DESCRIPTION OF REFERENCE NUMERALS INDICATING PRIMARY ELEMENTS IN THE DRAWINGS

Figure 1:
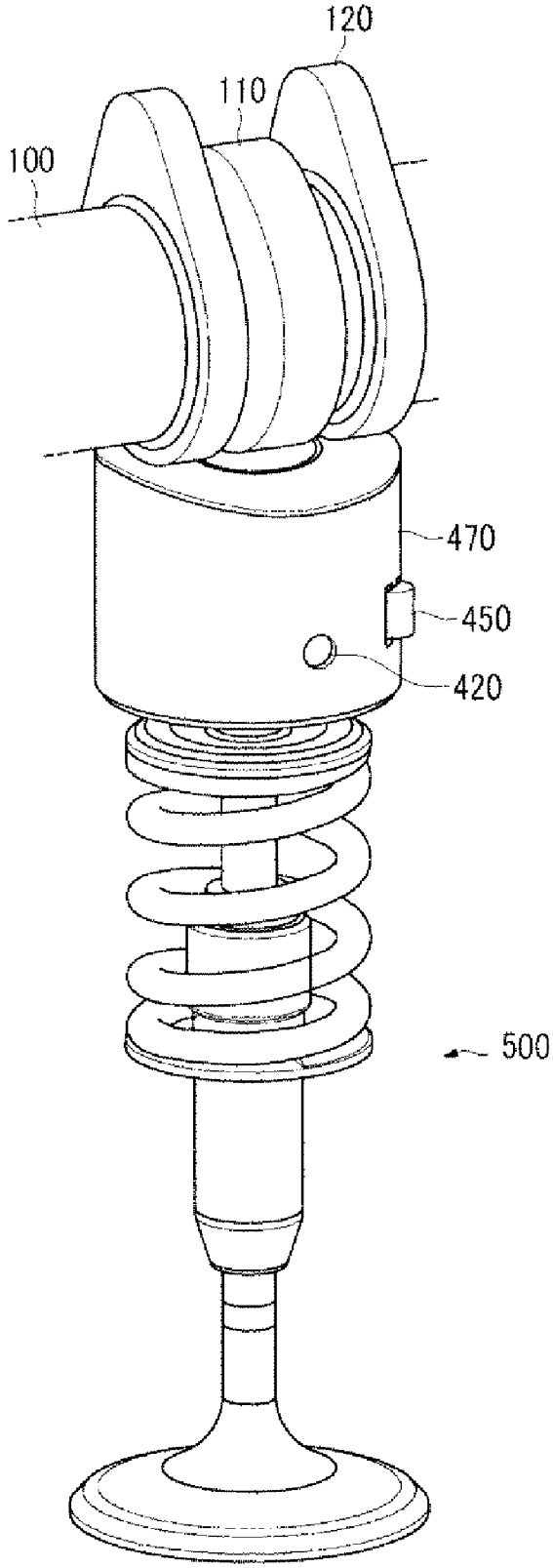
FIG. 1 is a perspective view of a variable valve lilt apparatus according to an exemplary embodiment of the present invention.

| | |
|---|---|
| 100: camshaft | 110: low lift cam |
| 120: high lift cam | 200: latching part |
| 210: latching pin guide | 220: latching pin |
| 225: latching pin spline | 230: latching pin elastic portion |
| 300: inner part | 310: inner body |
| 320: inner body spline | 330: inner body guide |
| 400: outer part | 410: outer body cap |
| 420: hydraulic line | 430: lost motion spring |
| 440: air hole | 450: locking pin |
| 460: fixing pin | 470: outer body |
| 480: spring seat | 490: spring seat fixing ring |
| 500: valve | |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Exemplary embodiments the present invention will be described more fully hereinafter with reference to the accompanying drawings.

Figure 2:
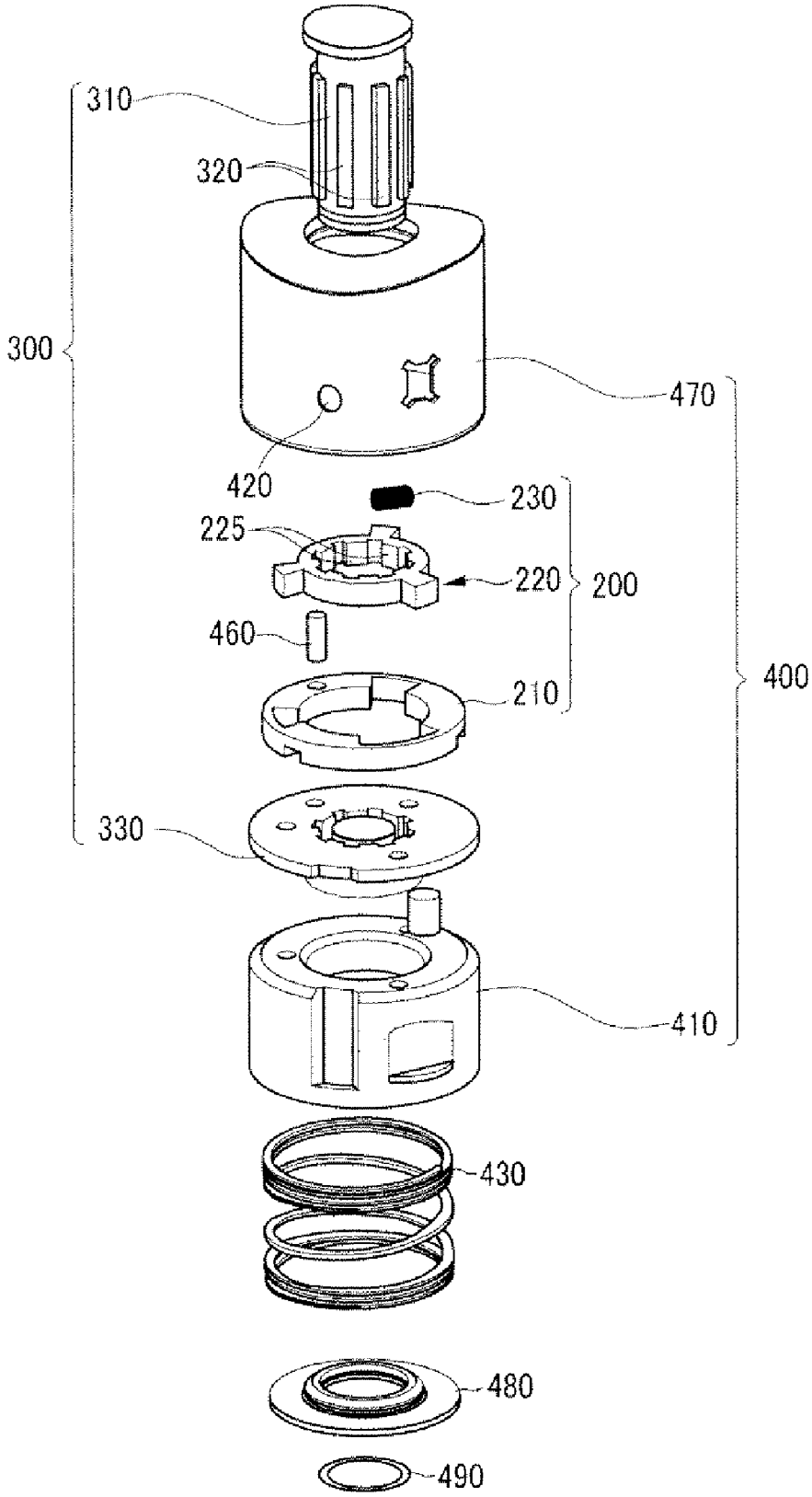
FIG. 2 is an exploded view of a variable valve lift apparatus according to an exemplary embodiment of the present invention, FIGS. 3 (A) and (B) are a partial cross-sectional view and a partial perspective view without an outer body of a variable valve lift apparatus according to an exemplary embodiment of the present invention, respectively, FIGS. 4 (A) and (B) are views showing an operation of a latching pin of a variable valve lift apparatus according to an exemplary embodiment of the present invention, FIGS. 5 (A) and (B) are views showing an operation of a latching pin of a variable valve lift apparatus according to another exemplary embodiment of the present invention.

FIG. 1 is a perspective view of a variable valve lift apparatus according to an exemplary embodiment of the present invention, and FIG. 2 is an exploded view of a variable valve lift apparatus according to an exemplary embodiment of the present invention.

A variable valve lift apparatus according to an exemplary embodiment of the present invention includes an outer part 400, an inner part 300 disposed in the outer part 400 and connected to a valve 500, and a latching part 200 that is disposed in the outer part 400 and selectively connects the outer pail 400 and the inner part 300.

The variable valve lift apparatus according to an exemplary embodiment of the present invention furl her includes a camshaft 100 supplying torque generated by an engine, a low lift cam 110 that is configured to the camshaft 100 and selectively supplies torque to the inner part 300, and a high lift cam 120 that is configured to the camshaft 100 and supplies torque to the outer part 400.

The high lift cam 120 always contacts the outer part 400, but the low cam 110 selectively contacts the inner part 300.

Figure 4:
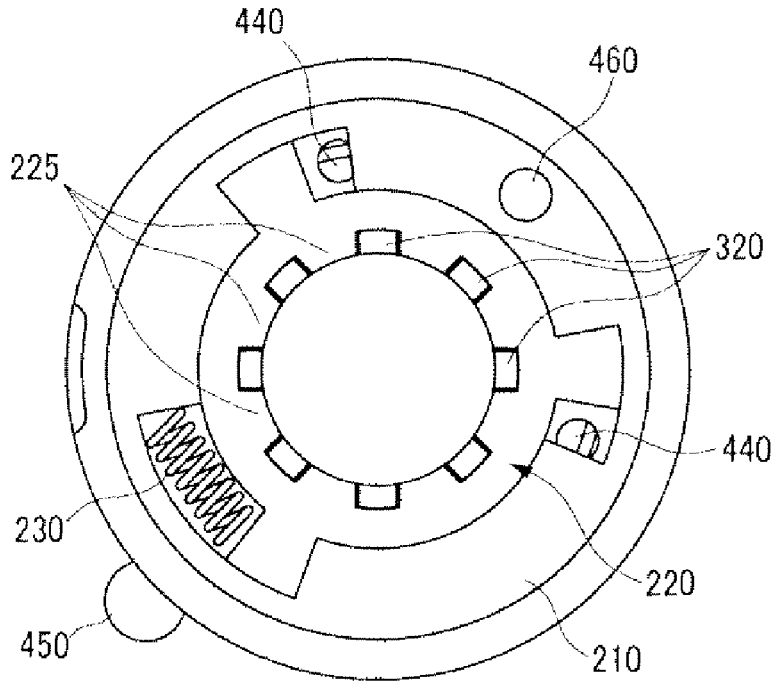
Figure 4:
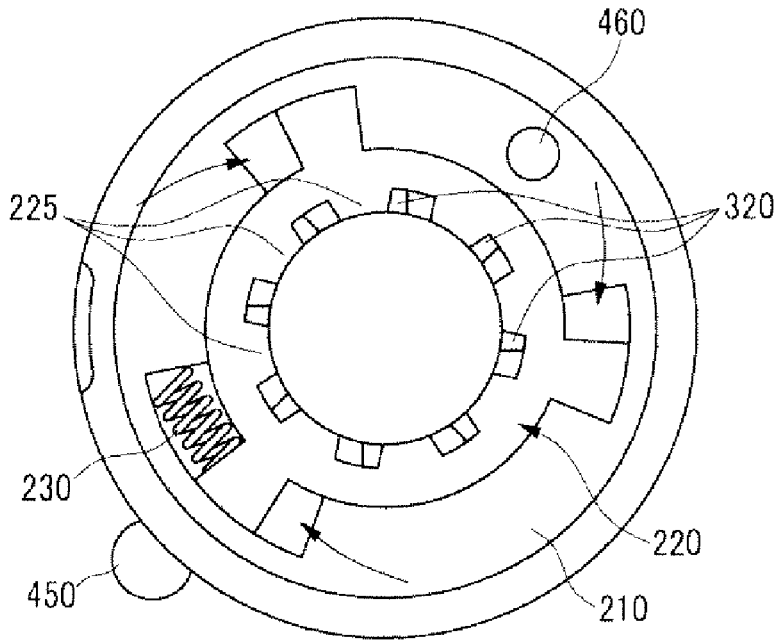

FIGS. 4 (A) and (B) are views showing an operation a low lift mode and a high lift mode of a latching pin of a variable valve lift apparatus according to an exemplary embodiment of the present invention respectively.

As shown in FIGS. 4 (A) and (B), the latching part 200 includes a latching pin guide 210, a latching pin 220 disposed in the latching pin guide, and a latching pin elastic portion 230 that is disposed in the latching pin guide 210 and supplies elastic force to the latching pin 220. The latching pin 220 is disposed pivotally with respect to the longitudinal axis of inner body 310.

As shown in FIG. 4(B), the latching pin 220 rotatably locks the inner part 300 when the latching pin 220 receives hydraulic pressure supplied through a hydraulic line 420.

Operation of the latching pin 220 will be explained later.

An air hole 440 is formed in the outer body 470 for the latching pin 220 to move smoothly.

Referring to FIG. 2, the inner part 300 includes an inner body 310 that has a cylindrical shape, has an inner body spline 320 formed on a circumference of the inner body 310, and is connected to the valve 500. An inner body guide 330 is disposed such that the inner body 310 may reciprocate through the inner body guide 330.

The latching pin 220 has a latching pin spline 225 on an interior circumference thereof, and the inner body 310 is disposed complementarily along the interior circumference of the latching, pin 220.

A locking pin 450 is disposed in the outer body 470 for preventing rotation of the outer body 470.

A fixing pin 460 is disposed in the outer body 470 for fixing relative positions of the outer body 470 and the latching pin guide 210.

A lost motion spring 430 is disposed in the outer body cap 410 for supplying elastic restoring force to support the outer part 400.

A spring seat 480 for configuring the lost motion spring 430 and a spring seat fixing ring 490 are shown in FIG. 2

Figure 3:
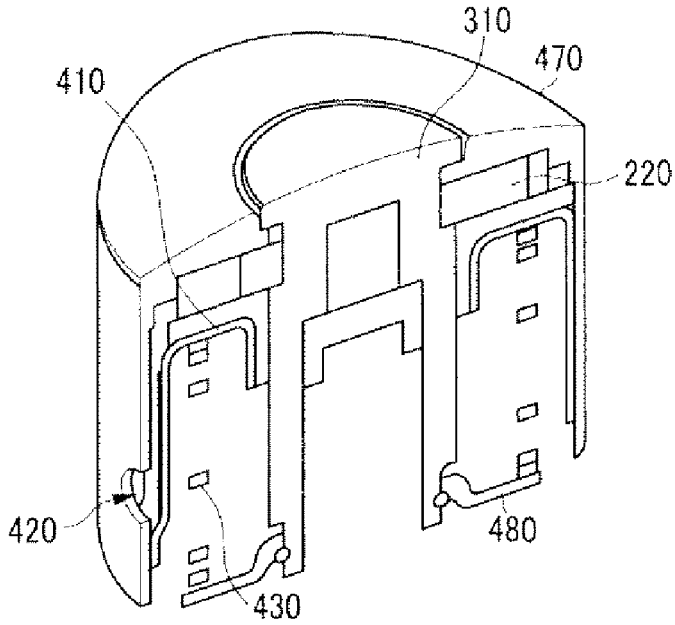
Figure 3:
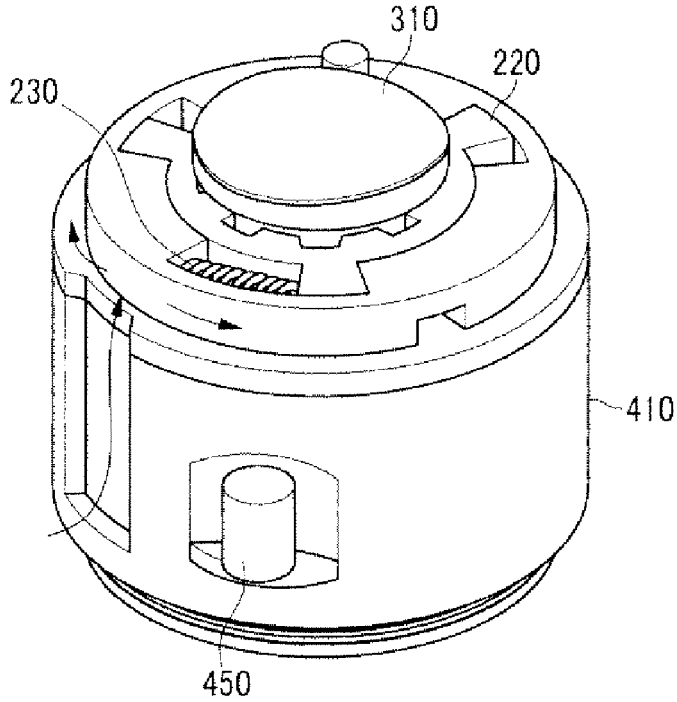

FIGS. 3 (A) and (B) are a partial cross-sectional view and a partial perspective view without an outer body of a variable valve lift apparatus according to an exemplary embodiment of the present invention, respectively.

As shown in FIGS. 3 (A) and (B), the outer part 400 includes an outer body cap 410 where a hydraulic line 420 for supplying hydraulic pressure is formed, and the outer body cap 410 fixes the inner body guide 330 and the outer body 470 enclosing the outer body cap 410.

Hydraulic pressure is supplied along arrow directions as shown in FIG. 3(B).

Hereinafter, an operation of the variable valve lift apparatus according to an exemplary embodiment will be explained.

Figure 6:
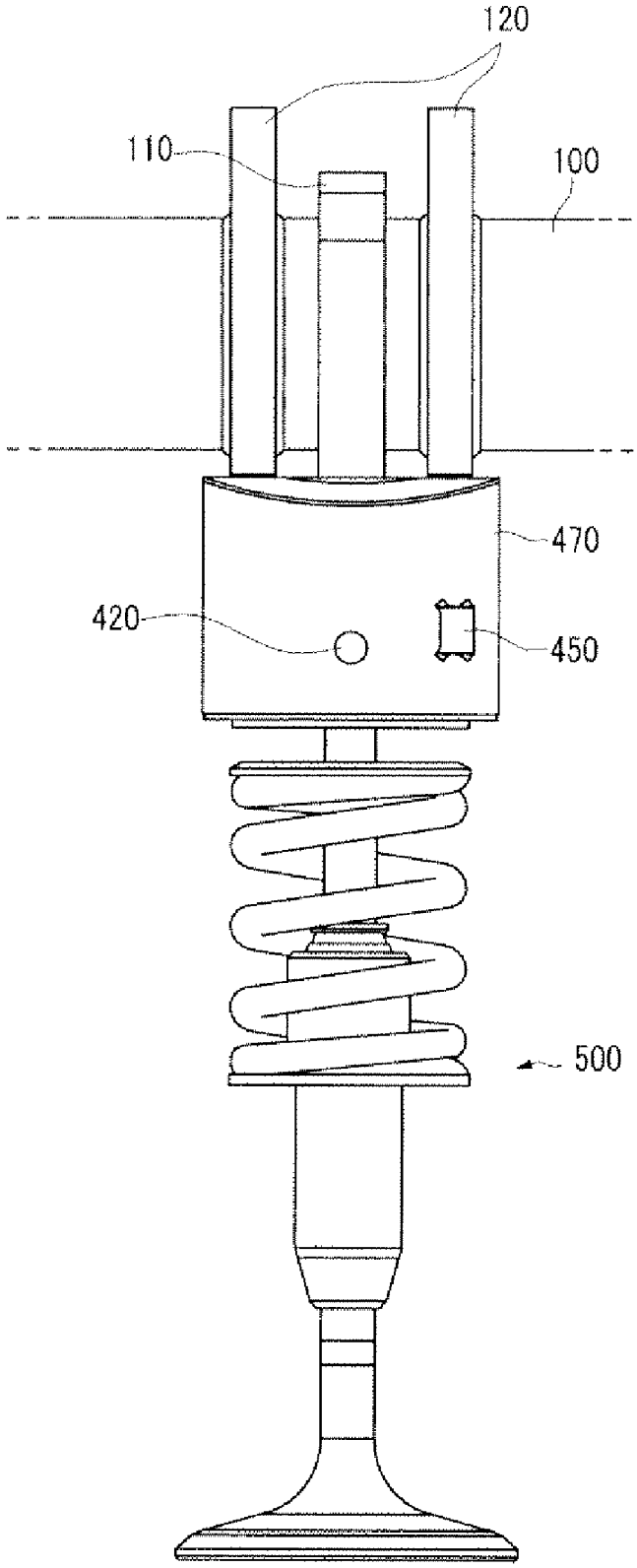
FIG. 6 is a front view showing a high lift mode of a variable valve lift apparatus according to an exemplary embodiment of the present invention.
Figure 7:
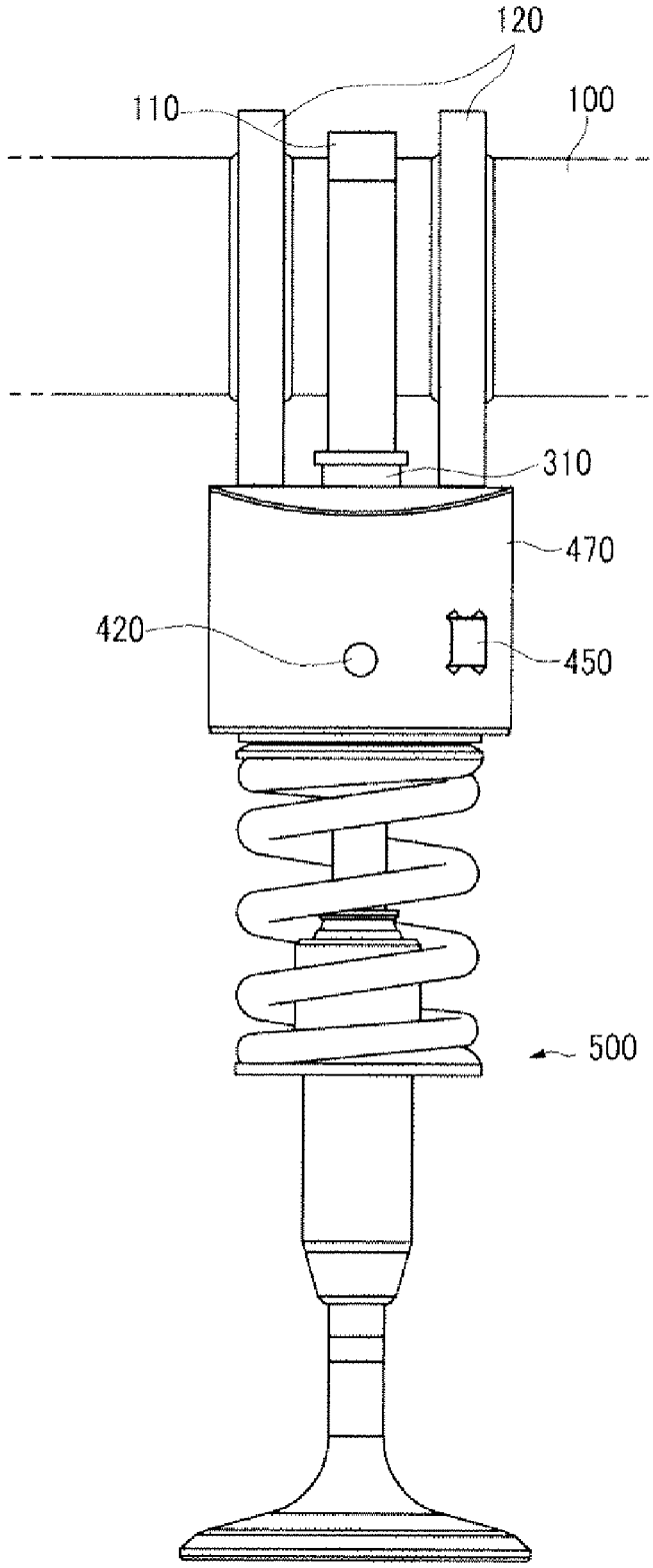
FIG. 7 is a view showing a low lift mode of a variable valve lift apparatus according to an exemplary embodiment of the present invention.

FIG. 6 is a front view showing a high lift mode of a variable valve lift apparatus according to an exemplary embodiment of the present invention, and FIG. 7 is a view showing a low lift mode of a variable valve lift apparatus according to an exemplary embodiment of the present invention.

When an engine starts, the variable valve lift apparatus operates in the low lift mode.

In the low lift mode, the latching pin 220 is disposed as shown in FIG. 4 (A), and the inner body 310 reciprocates along the latching pin splines 225 of the latching pins 220 without restriction, since the inner body splines 320 of the inner body 310 are not locked by the latching pin 220.

That is, as shown in FIG. 7, the inner body 310 and the outer body 470 are separated.

Thus, the valve 500 is opened and closed by rotation of the low lift cam 110 without regard to the high lift cam 120.

When the operation mode is changed to high lift mode as the speed of an engine is increased, hydraulic pressure is supplied through the hydraulic line 420. The supplied hydraulic pressure is applied to at least a lateral side portion of the latching pin 220.

Once the supplied hydraulic pressure overcomes the deformation force of the latching pin elastic portion 230, the hydraulic pressure rotates the latching pin 220 with respect to the longitudinal axis of the inner body 30 in a clockwise direction.

The hydraulic pressure may be applied to the latching pin 220 until the upper portion of the latching pin spline 225 of the inner body 310 is partially overlapped by the latching pin spline 225 of the latching pin as shown in FIG. 4(B).

Accordingly the upper portion of the inner body spline 320 of the inner body 310 is locked with the latching pin 220.

That is, the inner body 310 is combined with the outer body 470.

Thus, the valve 500 is closed and opened by rotation of the high lift cam 120, and it is appropriate to operate at a high speed because the lift amount and lift time are increased.

On the contrary, if the supplied hydraulic pressure is reduced, the restoring force of the latching pin elastic portion 230 pushes at least a lateral side portion of the latching pin 220 with respect to the longitudinal axis of the inner body 30 in a counterclockwise direction. As a result, the upper portion of the inner body spline 320 of the inner body 310 is unlocked from the latching pin 220. That is, the inner body 310 is separated from the outer body 470.

The variable valve lift apparatus that has a low lilt mode and a high lift mode has been described above, and hereinafter a variable valve lift apparatus that has a general mode and a CDA (cylinder deactivation) mode will be explained.

Figure 5:
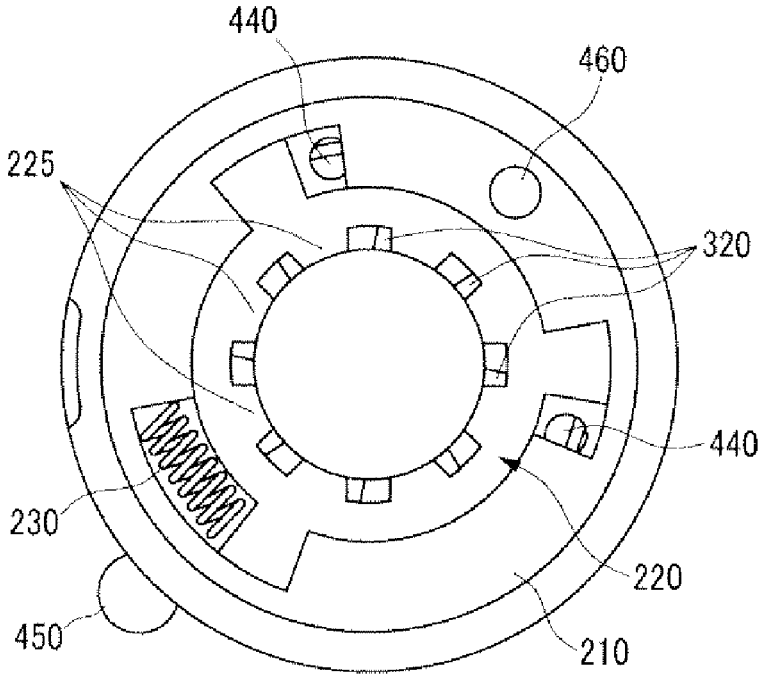
Figure 5:
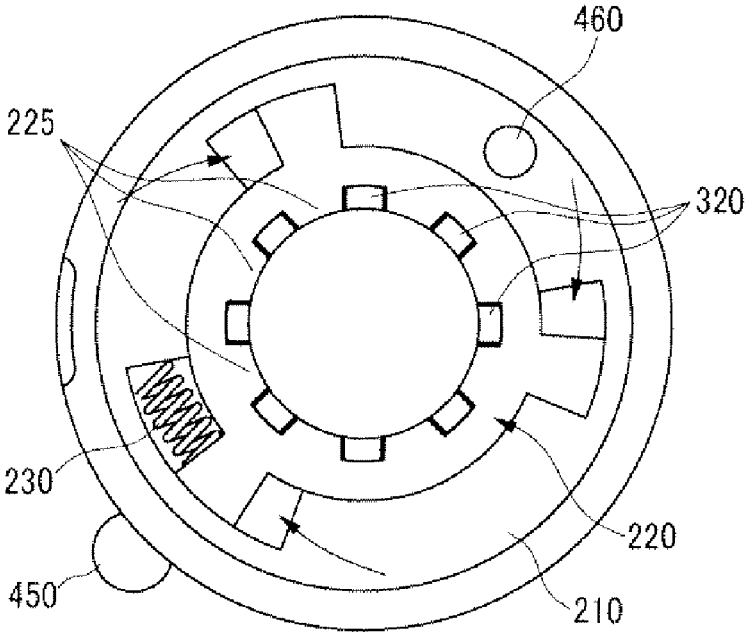

FIGS. 5 (A) and (B) are views showing an operation of a latching pin of a variable valve lift apparatus according to another exemplary embodiment of the present invention.

In FIGS. 5 (A) and (B), the same constituent elements will be designated by the same reference numbers and will be described by the same reference numbers as in other drawings.

A variable valve lift apparatus according to this exemplary embodiment of the present invention, which has a general mode and a CDA mode, starts in the general mode.

That is, as shown in FIG. 5 (A), a valve 500 is opened and closed by the latching pin 220 being combined with the inner body 310. Therefore, the inner body spline 320 and the latching pin spline 225 are initially combined to operate.

However, when some pistons of a vehicle is not required to operate, as shown in FIG. 5 (B), hydraulic pressure is supplied and the latching pin 220 and the inner body 310 are separated.

That is, the latching pin 220 rotates in a clockwise direction, and the inner body spline 320 and the latching pin spline 225 are released from the locking state.

In the CDA mode, the low lift cam that is used in the high lift mode and the low lift mode is not needed, and the valve 500 is not opened and closed.

in the CDA mode of the variable valve lift apparatus according to this exemplary embodiment of the present invention, excepting partial structure, partial operation, structure of the latching pin, and the number of cams of the high hit mode and low lift mode of the variable valve lift apparatus according to the previous exemplary embodiment of the present invention, other elements are the same, so a detailed description of similar parts will be omitted.

While this invention has been described in connection with what is presently considered so be practical exemplary embodiments, it is to be understood that the invention, is not limited to the disclosed embodiments, but, on the contrary, is intended to cover various modifications and equivalent arrangements included within the spirit and scope of the appended claims.

What is claimed is:

1. A variable valve lift apparatus comprising:

an outer part;

an inner part disposed in the outer part and connected to a proximate end portion of a valve;

a latching part that is disposed in the outer part and selectively connects the outer part and the inner part;

a camshaft supplying torque of an engine;

a low lift cam that is configured to the camshaft and selectively supplies the torque to the inner part; and a high lift cam that is configured to the camshaft and supplies the torque to the outer part;

wherein the latching part comprises:

a latching pin guide;

a latching pin disposed in the latching pin guide; and a latching pin elastic portion that is disposed in the latching pin guide and supplies elastic force to the latching pin, wherein the latching pin locks the inner part when the latching pin receives hydraulic pressure by overcoming a deformation force of the latching pin elastic portion; and wherein the inner part comprises:

an inner body that has a cylindrical shape, has at least an inner body spline formed on a circumference of the inner body, and is connected to the proximate end portion of the valve; and an inner body guide that is disposed for accommodating the inner body to reciprocate, wherein the latching pin has at least a latching pin spline formed on an interior circumference thereof and the inner body is disposed complementarily along the interior circumference of the latching pin.

2. The variable valve lift apparatus of claim 1, wherein the outer part comprises:

an outer body cap where at least a hydraulic line for supplying the hydraulic pressure is formed, and the outer body cap fixes the inner body guide; and an outer body enclosing the outer body cap.

3. The variable valve lift apparatus of claim 2, wherein a lost motion spring is disposed in the outer body cap for supplying elastic restoring force to the outer part.

4. The variable valve lift apparatus of claim 2, wherein at least an air hole is formed in the outer body for the latching pin to move smoothly.

5. The variable valve lift apparatus of claim 2, wherein at least a locking pin is disposed in the outer body for preventing rotation of the outer body.

6. The variable valve lift apparatus of claim 2, wherein at least a fixing pin is disposed in the outer body for fixing relative positions of the outer body and the latching pin guide.

7. A variable valve lift apparatus comprising:

an outer part;

an inner part disposed in the outer part and connected to a proximate end portion of a valve;

a latching part that is disposed in the outer part and selectively connects the outer part and the inner part;

a camshaft supplying torque of an engine; and a cam that is configured to the camshaft and supplies the torque to the outer part;

wherein the latching part comprises:

a latching pin guide;

a latching pin disposed in the latching pin guide; and a latching pin elastic portion that is disposed in the latching pin guide and supplies elastic force to the latching pin;

wherein the latching pin releases the inner part when the latching pin receives hydraulic pressure by overcoming a deformation force of the latching pin elastic portion; and wherein the inner part comprises:

an inner body that has a cylindrical shape, has at least an inner body spline formed on a circumference of the inner body and is connected to the proximate end portion of the valve; and an inner body guide that is disposed for the inner body to reciprocate, wherein the latching pin has at least a latching pin spline formed on an interior circumference thereof and the inner body is disposed complementarily along the interior circumference of the latching pin.

8. The variable valve lift apparatus of claim 7, wherein the outer part comprises:

an outer body cap where at least a hydraulic line for supplying the hydraulic pressure is formed, and the outer body cap fixes the inner body guide; and an outer body enclosing the outer body cap.

9. The variable valve lift apparatus of claim 8, wherein a lost motion spring is disposed in the outer body cap for supplying elastic restoring force to the outer part.

10. The variable valve lift apparatus of claim 8, wherein at least an air hole is formed in the outer body for the latching pin to move smoothly.

11. The variable valve lift apparatus of claim 8, wherein at least a locking pin is disposed in the outer body for preventing rotation of the outer body.

12. The variable valve lift apparatus of claim 8, wherein at least a fixing pin is disposed in the outer body for fixing relative positions of the outer body and the latching pin guide.

* * * * *